US010249467B2

(12) United States Patent
Thaury et al.

(10) Patent No.: US 10,249,467 B2
(45) Date of Patent: Apr. 2, 2019

(54) LASER PLASMA LENS

(71) Applicants: ECOLE POLYTECHNIQUE, Palaiseau (FR); ECOLE NATIONALE SUPÉRIEURE DE TECHNIQUES AVANCÉES, Palaiseau (FR)

(72) Inventors: Cédric Thaury, Montigny le Bretonneux (FR); Rémi Lehe, Paris (FR); Victor Malka, Paris (FR); Emilien Guillaume, Paris (FR)

(73) Assignees: ECOLE POLYTECHNIQUE, Palaiseau (FR); ECOLE NATIONALE SUPÉRIEURE DE TECHNIQUES AVANCÉES, Palaiseau (FR)

( * ) Notice: Subject to any disclaimer, the term of this patent is extended or adjusted under 35 U.S.C. 154(b) by 0 days.

(21) Appl. No.: 15/524,984

(22) PCT Filed: Nov. 4, 2015

(86) PCT No.: PCT/EP2015/075740

§ 371 (c)(1),
(2) Date: May 5, 2017

(87) PCT Pub. No.: WO2016/071413

PCT Pub. Date: May 12, 2016

(65) Prior Publication Data

US 2017/0323757 A1 Nov. 9, 2017

(30) Foreign Application Priority Data

Nov. 5, 2014 (FR) ..... 14 60696

(51) Int. Cl.
*H05H 1/46* (2006.01)
*H01J 23/08* (2006.01)
(Continued)

(52) U.S. Cl.
CPC ..... *H01J 23/08* (2013.01); *H01J 25/02* (2013.01); *H05H 1/46* (2013.01); *H05H 15/00* (2013.01)

(58) Field of Classification Search
None
See application file for complete search history.

(56) References Cited

U.S. PATENT DOCUMENTS 4,886,958 A * 12/1989 Merryman ..... G02B 26/10 250/201.4
5,077,774 A * 12/1991 Piestrup ..... G03F 7/70033 378/119

(Continued)

OTHER PUBLICATIONS

Khachatryan et al. "Femtosecond Electron-bunch Dynamics in Laser Wakefields and Vacuum", Physical Review Special Topics—Accelerators and Beams, vol. 10, No. 12, pp. 1-13, 2007.

(Continued)

*Primary Examiner* — Dion R Ferguson
*Assistant Examiner* — Srinivas Sathiraju
(74) *Attorney, Agent, or Firm* — Oliff PLC

(57) ABSTRACT

A device for collimation or focusing of a relativistic electron packet, obtained in particular by laser-plasma acceleration, including a gas cloud and a laser capable of emitting a laser pulse focused in the gas cloud in order to create therein a wave of focusing electric and magnetic fields. The invention also relates to a device for emission of a collimated or focused relativistic electron packet. The invention further relates to a collimation or focusing method for a relativistic electron packet, and to methods for emission of a collimated or focused relativistic electron packet.

22 Claims, 3 Drawing Sheets

(51) Int. Cl.
*H05H 15/00* (2006.01)
*H01J 25/02* (2006.01)

(56) References Cited

U.S. PATENT DOCUMENTS

| | | | | |
|---|---|---|---|---|
| 5,912,939 | A * | 6/1999 | Hirsch | H05G 2/001 378/190 |
| 7,317,192 | B2 * | 1/2008 | Ma | G21K 1/08 250/298 |
| 8,436,327 | B2 * | 5/2013 | Balakin | A61N 5/10 250/396 R |
| 9,018,601 | B2 * | 4/2015 | Balakin | A61N 5/1049 250/396 ML |
| 9,660,408 | B2 * | 5/2017 | Ta Phuoc | H01S 3/005 |
| 9,768,580 | B2 * | 9/2017 | Tajima | H01S 3/067 |
| 2003/0174303 | A1 * | 9/2003 | Naulleau | G03F 7/70091 355/71 |
| 2005/0147147 | A1 * | 7/2005 | Umstadter | H01S 3/30 372/73 |
| 2007/0296966 | A1 * | 12/2007 | Benicewicz | G01J 3/2889 356/318 |
| 2012/0327963 | A1 * | 12/2012 | Hubbard | H01S 3/0057 372/29.014 |
| 2015/0085892 | A1 * | 3/2015 | Ta Phuoc | H05G 2/00 372/76 |
| 2016/0302295 | A1 * | 10/2016 | Umstadter | H05G 2/001 |

OTHER PUBLICATIONS

Li et al. "Electron Acceleration in a Two-stage Laser Wakefield Accelerator", AIP Conference Proceedings, vol. 1462, pp. 143-148, 2012.

Pollock et al. "Demonstration of a Narrow Energy Spread, -0.5 GeV Electron Beam From a Two-stage Laser Wakefield Accelerator", Physical Review Letters, vol. 107, No. 4, pp. 045001-1-045001-4, 2011.

Schroeder et al. "Control of Focusing Forces and Emittances in Plasma-based Accelerators Using Near-hollow plasma Channels", Physics of Plasmas, vol. 20, No. 8, pp. 080701-1-080701-5, 2013.

Schroeder et al. "Beam Loading in a Laser-plasma Accelerator using a Near-hollow Plasma Channel", Lawrence Berkeley National Laboratory, pp. 1-21, 2014.

Wang et al. "Control of Seeding Phase for a Cascaded Laser Wakefiled Accelerator With Gradient Injection", Applied Physics Letters, vol. 103, No. 24, pp. 243501-1-243501-5, 2013.

P. Chen, "Possible Final Focusing Mechanism for Linear Colliders", Particle Accelerators, vol. 20, pp. 171-182, 1987.

Jan. 15, 2016 International Search Report issued in International Patent Applciation No. PCT/EP2015/075740.

May 9, 2017 International Preliminary Report on Patentability issued in International Patent Applciation No. PCT/EP2015/075740.

* cited by examiner

LASER PLASMA LENS

BACKGROUND OF THE INVENTION

Field of the Invention

The present invention relates to a device and a method for collimating or focusing a bunch of electrons, and a device and a method for emitting a bunch of relativistic electrons.

A "relativistic electron" should be understood to be an electron whose speed of displacement is not inconsiderable relative to the speed of light, notably whose speed is greater than 90% of the speed of light.

Description of Related Art

A so-called "laser-plasma" electron acceleration method is known. This method makes it possible to generate a bunch of electrons of high energy—conventionally a few hundreds of MeV—by focusing an intense laser pulse in a gas jet. The laser pulse creates a wave of electrical and magnetic fields which accelerate electrons present in the gas.

This method offers numerous advantages over the conventional electron acceleration techniques. In particular, this method may be implemented by means of a compact device, a distance of a few millimeters being sufficient to accelerate the electrons to an energy level of a few hundreds of MeV, whereas several tens of meters are needed to achieve such an energy level with conventional methods.

Moreover, the laser-plasma acceleration generates bunches of electrons that are extremely short, conventionally of the order of a few femtoseconds, and of very limited size, conventionally a few micrometers. Bunches of electrons with such characteristics are difficult to generate with conventional accelerators.

However, the bunches of electrons produced by laser-plasma acceleration exhibit a divergence which makes them difficult to use in practice.

This divergence of the bunches of electrons is difficult to correct with the known devices, such as the magnetic quadrupoles. In effect, the focusing force of a magnetic quadrupole is relatively weak. A quadrupole must therefore be placed several decimeters behind the source of the bunch of relativistic electrons, the bunch of electrons diverging accordingly between the source and the quadrupole, leading to a significant degradation of its emittance. The quadrupoles also have the disadvantage of being focusing only according to one of the two transverse directions—thus making it necessary to combine two or even three quadrupoles in order to obtain a suitable focusing.

Also known, notably from the article "*A possible final focusing mechanism for linear colliders*", P. Chen, Particle Accelerators, 1987, Vol. 20, pp. 171-182, is a method for focusing a bunch of electrons using a plasma. According to this article, the bunch of electrons entering into a plasma generates therein, in its wake, a wave of focusing electrical fields. However, this method does not make it possible to focus all of the bunch of electrons, only a rear part of this bunch of electrons (in relation to the direction of propagation of the bunch of electrons). In the case of a very short bunch of electrons, as typically obtained by implementing a laser-plasma acceleration method, the part of the bunch of electrons located in the focusing zone is reduced to zero and the bunch of electrons is no longer focused at all by the wave of focusing electrical fields.

There is therefore a need for a focusing or collimation device that does not exhibit the abovementioned drawbacks and that notably makes it possible to focus or collimate a bunch of electrons obtained by laser-plasma acceleration.

BRIEF SUMMARY OF THE INVENTION

The invention addresses this need by proposing a device for collimating or focusing a bunch of relativistic electrons, notably obtained by laser-plasma acceleration, comprising a gas cloud and a laser suitable for emitting a laser pulse focused in the gas cloud to create therein a wave of focusing electrical and magnetic fields.

Focusing an electron beam should be understood to mean concentrating this electron beam. Collimating an electron beam should be understood to mean orienting this beam in one direction.

According to the invention, a bunch of relativistic electrons is collimated or focused by means of a wave of focusing electrical and magnetic fields to which the bunch of relativistic electrons is subjected. This wave of electrical and magnetic fields is formed by a laser pulse propagated in a gas cloud. This laser pulse locally ionizes the gas cloud, forming focusing electrical and magnetic fields. This wave of focusing fields is displaced following the laser pulse.

Such a device is significantly more compact than the known devices.

Compared to the quadrupoles, it also offers the advantage of simultaneously focusing the electrons in the two transverse directions relative to the direction of propagation of the bunch of electrons. Depending on the form of the laser pulse, it is also possible to obtain a different focusing or collimating effect in the two transverse directions.

The invention also relates to a device for emitting a bunch of collimated or focused relativistic electrons, comprising:

- a first gas cloud,
- a laser suitable for emitting a laser pulse focused in the first gas cloud to create therein a first wave of electrical and magnetic fields for accelerating electrons present in the gas and thus form a bunch of relativistic electrons which is propagated out of the first gas cloud, and
- a collimating or focusing device as described above, placed on the trajectory of propagation of the bunch of relativistic electrons, the gas cloud of the collimating or focusing device being remote from said first gas cloud.

According to a first variant, the device for emitting a bunch of collimated or focused relativistic electrons may comprise a single laser suitable for emitting a laser pulse focused both in the first gas cloud to create therein a first wave of electrical and magnetic fields for accelerating electrons present in the gas, and in the gas cloud of the collimating or focusing device to create therein a wave of focusing electrical and magnetic fields.

According to another variant, the device for emitting a bunch of collimated or focused relativistic electrons comprises one or two distinct lasers suitable for emitting two distinct laser pulses, of which one is focused in the first gas cloud to create therein a first wave of electrical and magnetic fields for accelerating electrons present in the gas, and of which the other is focused in the gas cloud of the collimating or focusing device to create therein a wave of focusing electrical and magnetic fields.

The electron densities of the first and of the second gas cloud may lie our $1.10^{17}$ $cm^{-3}$ and $1.10^{20}$ $cm^{-3}$. The density of the first gas cloud is chosen primarily as a function of the laser characteristics. The density of the second gas cloud is chosen primarily as a function of the laser characteristics, of the length of the second gas cloud and of the distance between the two gas clouds. The density of the second cloud may notably be less than that of the first gas cloud. As a variant, however, the density of the two gas clouds is substantially equal.

The distance between the first gas cloud and the gas cloud of the collimating or focusing device is greater than 300 μm and/or less than 5 mm, preferably less than 2 mm.

The device for emitting a bunch of collimated or focused relativistic electrons may comprise at least one out of a capillary, a discharge capillary, a capillary leak system, a sonic nozzle, a supersonic nozzle and a gas cell to produce each gas cloud.

The width of the gas cloud of the collimating or focusing device may lie between 10 μm and 2 mm. In the case where a single laser beam is implemented, the gas cloud of the collimating or focusing device may be wider than 2 mm. However, in this latter case, only the upstream portion of the gas cloud, in the direction of propagation of the bunch of electrons, has a real collimating or focusing effect on the bunch of electrons.

The laser pulse emitted by the laser of the collimating or focusing device may have a duration lying, for example, between 5 and 500 femtoseconds, and a peak power lying, for example, between 10 terawatt and 10 petawatt.

According to another aspect, the invention relates to a method for collimating or focusing a bunch of relativistic electrons, notably by means of a collimating or focusing device as described above, comprising the steps consisting in:

- emitting a laser pulse focused in a gas cloud to create therein a wave of focusing electrical and magnetic fields, and
- subjecting the bunch of relativistic electrons to said wave of focusing electrical and magnetic fields.

The invention also targets a method for emitting a bunch of collimated or focused relativistic electrons, comprising the steps consisting in:

- emitting a laser pulse focused in a first gas cloud to create therein a wave of electrical and magnetic fields for accelerating electrons present in the gas and thus form a bunch of relativistic electrons which is propagated out of the first gas cloud, the laser pulse also being focused in a second gas cloud to create therein a wave of focusing electrical and magnetic fields, the first gas cloud being remote from the second gas cloud,
- subjecting the bunch of relativistic electrons to the wave of focusing electrical and magnetic fields.

The invention also relates to a method for emitting a bunch of collimated or focused relativistic electrons, comprising the steps consisting in:

- emitting a first laser pulse focused in a first gas cloud to create therein a wave of electrical and magnetic fields for accelerating electrons present in the gas and thus form a bunch of relativistic electrons which is propagated out of the first gas cloud,
- emitting a second laser pulse focused in a second gas cloud to create therein a wave of focusing electrical and magnetic fields, the first gas cloud being remote from the second gas cloud, and
- subjecting the bunch of relativistic electrons to the wave of focusing electrical and magnetic fields.

The distance between the first gas cloud and the second gas cloud may be greater than 300 μm and/or less than 5 mm, preferably less than 2 mm.

The electron densities of the first and of the second gas cloud may lie our $1.10^{17}$ $cm^{-3}$ and $1.10^{20}$ $cm^{-3}$. The density of the first gas cloud is chosen primarily as a function of the laser characteristics. The density of the second gas cloud is chosen primarily as a function of the laser characteristics, of the length of the second gas cloud and of the distance between the two gas clouds.

The width of the gas cloud or of the second gas cloud, where appropriate, may lie between 10 μm and 2 mm.

The laser pulse or the second laser pulse, where appropriate, may have a duration lying, for example, between between 5 and 500 femtoseconds, and a peak power lying, for example, between 10 terawatt and 10 petawatt.

BRIEF DESCRIPTION OF THE SEVERAL VIEWS OF THE DRAWINGS

The attached figures will give a good understanding of how the invention may be produced. Among these.

DETAILED DESCRIPTION OF THE INVENTION

Hereinafter in the description, the elements that are identical or of identical function bear the same reference sign in the different embodiments. For conciseness in the present description, these elements are not described with respect to each of the embodiments, only the differences between the embodiments being described.

Figure 1:
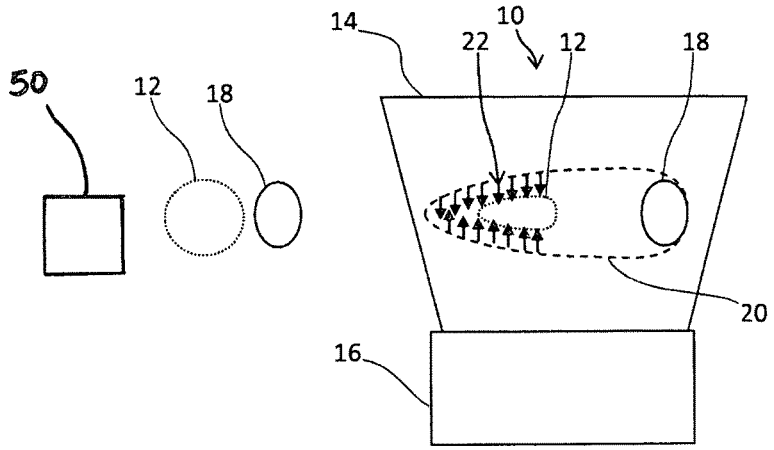
FIG. 1 schematically represents a device for collimating or focusing a bunch of relativistic electrons.

As illustrated in FIG. 1, a device for collimating or focusing 10 a bunch of relativistic electrons 12 comprises an ionizable gas cloud 14, formed here by means of a nozzle 16, and a laser (not represented) suitable for emitting a laser pulse 18 focused in the gas cloud 14 to create therein a wave of focusing electrical and magnetic fields.

Thus, the laser pulse 18 ionizes the gas of the gas cloud 14. That done, the laser pulse 18 forms, in its wake 20, focusing electrical and magnetic fields 22 (or "focusing wakefield"). The laser pulse 18, being displaced in the gas cloud, creates a wave of focusing electrical and magnetic fields 22, in the wake 20 of the laser pulse 18. These focusing electrical and magnetic fields 22, to which the bunch of relativistic electrons 12 is subjected, make it possible to collimate or focus the bunch of relativistic electrons 12.

The laser pulse emitted by the laser may have a duration lying between 5 and 500 femtoseconds. The laser pulse emitted may also have a peak power lying between 10 terawatt and 10 petawatt.

The width of the gas cloud lies for example between 10 μm and 2 mm.

Such a device makes it possible to implement the method for collimating or focusing a following bunch of relativistic electrons. Initially, a laser pulse 18 is emitted that is focused in an ionizable gas cloud 14, to create therein a wave of focusing electrical and magnetic fields 22. Then, the bunch of relativistic electrons 12 is subjected to said wave of focusing electrical and magnetic fields 22.

Preferably, the pair comprising length of the gas cloud 14 and electron density in the gas cloud 14 is chosen to limit the energy variation of the electrons between entry into the gas cloud 14 and exit from this gas cloud 14. This energy variation $|E_{exit}-E_{entry}|/E_{entry}$, between the energy $E_{entry}$ of the electrons on entering into the gas cloud 14 and the energy $E_{exit}$ of the electrons on exiting from the gas cloud 14, is advantageously less than 50%, better less than 40%, even better less than 30%, preferably even less than 20% and even more preferably less than 10%.

According to a variant, in order to collimate the electron beam exiting from the gas cloud, the pair comprising length of the gas cloud 14 and electron density in the gas cloud 14 is chosen to reduce a factor equal to the ratio of the divergence of the electron beam divided by the energy of the electrons to the power ¾. In particular, this pair may be chosen to reduce this factor by a ratio of two, or preferably, by a ratio greater than two, between entry into the gas cloud 14 and exit from this gas cloud 14. Where appropriate, the distance between the source of the electron beam 12 and the gas cloud 14 may also be determined, in conjunction with the pair comprising length of the gas cloud 14 and electron density in the gas cloud 14, to reduce this factor, by a factor of two or, preferably, by a factor greater than two.

According to another variant, in which a focusing of the electron beam is sought, the pair comprising length of the gas cloud 14 and electron density in the gas cloud 14 is chosen to reduce the dimensions of the electron beam in at least one plane transversal to the direction of propagation of the beam, preferably in all the planes transversal to the direction of propagation of the beam, on exiting from the gas cloud 14 relative to its dimensions on entering the gas cloud 14. Preferably, these dimensions in a transverse plane, preferably in all the transverse planes, are reduced by a factor of two, more preferably by a factor greater than two. Where appropriate, the distance between the source of the electron beam 12 and the gas cloud 14 may also be determined, in conjunction with the pair comprising length of the gas cloud 14 and electron density in the gas cloud 14, to reduce the dimensions of the electron beam 12 in a transverse plane, preferably in all the transverse planes, by a factor of two or, preferably, by a factor greater than two.

Figure 2:
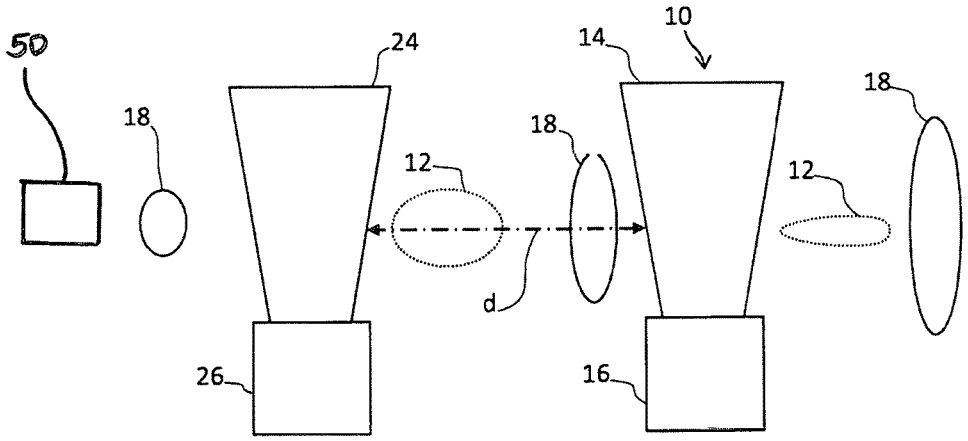
FIG. 2 schematically illustrates an example of a device for emitting a bunch of collimated or focused relativistic electrons, implementing a single laser pulse.

FIG. 2 represents a device for emitting a bunch of collimated or focused relativistic electrons 100 according to a first example, implementing a collimating or focusing device 10 as illustrated in FIG. 1.

More specifically, this device 100 comprises, first of all, a first gas cloud 24, formed here by means of a first nozzle 26, a laser (not represented) suitable for emitting a laser pulse 18 focused in the first gas cloud 24. The laser pulse 18 being propagated in the first gas cloud 24 locally ionizes this gas and forms, in its wake, acceleration electrical and magnetic fields which are applied to the electrons present in the first gas cloud 24. With the laser pulse 18 being displaced in the first gas cloud 24, a wave of acceleration electrical and magnetic fields is thus created, these electrical and magnetic fields being applied to the electrons in the wake of the laser pulse 18.

Typically, in this first gas cloud 24, the electrical and magnetic fields formed in the wake of the laser pulse are of the so-called "bubble regime" or "blow-out regime".

Such a bubble regime corresponds to a laser intensity significantly greater than 2.1018 W·cm-2, with a diameter of the laser of the order of the plasma wavelength of the gas cloud, and with a laser pulse duration of the order of magnitude of the plasma period of the gas cloud.

Furthermore, to allow for the "self-injection" of electrons, the density of the gas in the first gas cloud may be chosen to be relatively high, for example greater than $10^{19}$ molecules per $cm^3$.

As a variant or additionally, electrons may be injected by using a heavier gas, typically nitrogen or argon, whereas helium or hydrogen, or a gas mixture, is generally used, and/or by using one or more other laser pulses, and/or by placing an object on the gas jet output.

Figure 3:
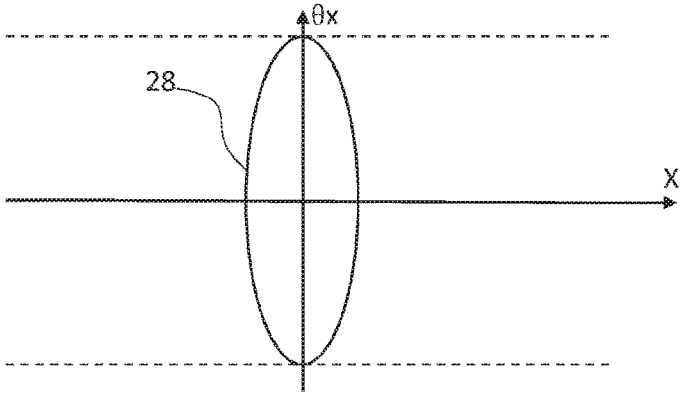
FIGS. 3 to 5 schematically illustrate spaces of the phases showing the focusing of a bunch of electrons by means of the device of FIG. 2.

Thus, a bunch of electrons is formed which is displaced in the wake of the laser pulse, accelerated by the electrical and magnetic fields formed in the wake of the laser pulse. Each electron of this bunch of electrons produces oscillations transverse to the direction of propagation of the bunch of electrons. The bunch of electrons 12 thus exhibits, on exiting from the first gas cloud 24, a phase portrait 28 of the bunch of electrons 12, as represented in FIG. 3. This figure represents the phase portrait of the bunch of relativistic electrons in a single transverse direction, it being understood that, with a laser pulse of substantially circular section, this phase portrait is substantially identical in two right-angled transverse directions. Here,

- X represents one of the coordinates (X, Y, Z) of an electron, in a plane (O, x, y) normal to the direction of propagation z of the bunch of electrons, and
- θx represents the angle between the axis of propagation z of the bunch of electrons and the speed vector of the electron, in a plane (O, y, z).

This phase portrait, in the form of an ellipse elongated in the direction θx, demonstrates the relatively significant divergence of the bunch of electrons 12 in the first gas cloud 24 and, above all, on exiting therefrom.

This bunch of relativistic electrons 12 is then propagated out of this first gas cloud 24, to a second gas cloud 14 of a collimating or focusing device 10 as described previously in light of FIG. 1. Between the first gas cloud 24 and the gas cloud 14 of the collimating or focusing device 10 (hereinafter, second gas cloud 14), the bunch of relativistic electrons 12 is propagated freely in the vacuum. "Vacuum" is understood to preferably mean an electron density between the two gas clouds less than 40%, preferably less than 20% and even more preferably less than 1% of the electron density of the second gas cloud. The distance d between the first and second gas clouds 24, 14 is for example greater than 300 μm and/or less than 5 mm, preferably less than 2 mm.

Figure 4:
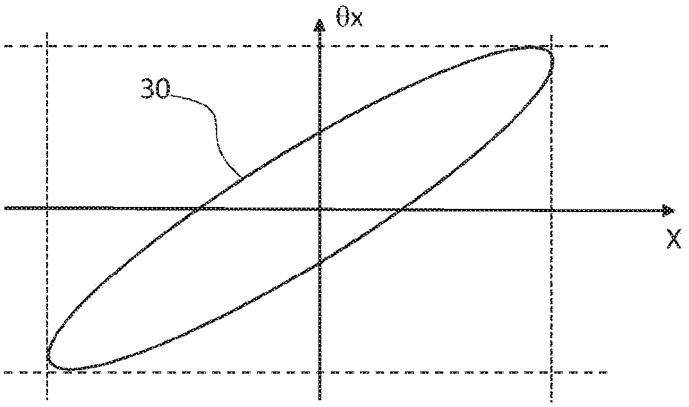
Figure 5:
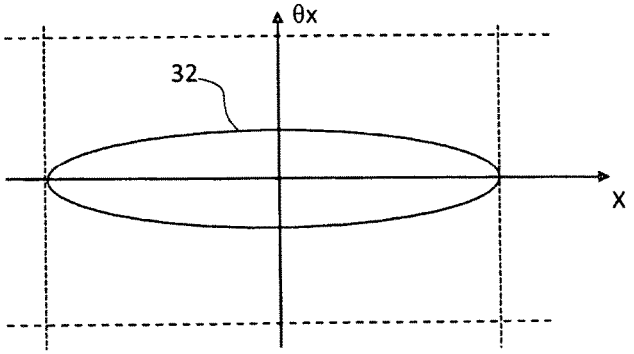

As illustrated by the phase portrait 30 of FIG. 4, during this propagation in the vacuum of the bunch of electrons, the electrons diffract freely and, in the absence of electrical and magnetic fields in the wake of the laser pulse 18, the bunch of electrons 12 widens radially. This is reflected in a stretching of the phase portrait in the direction X, but with constant values of θx.

Then, the bunch of relativistic electrons 12 penetrates into the second gas cloud 14. The laser pulse 18 creates, in its wake, a new wave of electrical and magnetic fields which have a focusing or collimating effect. This laser pulse 18 and the second gas cloud 14 form a collimating or focusing device 10 as already described in light of FIG. 1.

The electrical and magnetic fields formed in the wake of the laser pulse 18 in the second gas cloud 14 are conventionally in linear or quasi-linear regime. The electrical and magnetic fields in the second gas cloud are therefore a priori weaker than in the first gas cloud. Thus, the bunch of relativistic electrons pivots more slowly in the phase portrait. At certain points of this rotation, the phase portrait 32 of the bunch of electrons is aligned with the axis X and the divergence is minimal. A collimating effect is obtained when the gas cloud stops at these points. To obtain a focusing effect, it is possible to continue to rotate the ellipse of the phase portrait of the bunch of electrons to obtain an ellipse such that most of the electrons bear out that if x>0, then θx<0 and vice versa (in other words, a phase portrait is produced that is substantially symmetrical, relative to the axis θx, to the phase portrait of FIG. 4).

Thus, it has been proven that the length of the second gas cloud 14, the distance d between the two jets and the electron density in the second gas cloud 14 may be determined to obtain a minimum value of divergence of the bunch of electrons 12 on exiting the second gas cloud 14.

In practice however, it is possible to obtain a minimum divergence of the bunch of electrons 12, for a given gas density in the second gas cloud 14 and for a given length of this second gas cloud 14, by shifting the first and second gas clouds relative to one another to modify the distance d. As a variant, the length of the second gas cloud 14 and the distance between the first and second gas clouds are set, and the density of the gas of the second gas cloud is modified until an optimal collimation or focusing effect is obtained.

Preferably, the triplet comprising length of the second gas cloud 14, distance d between the two gas clouds and electron density in the second gas cloud 14 is chosen to limit the energy variation of the electrons between entry into the second gas cloud 14 and exit from this second gas cloud 14. This energy variation $|E_{exit}-E_{entry}|/E_{entry}$, between the energy $E_{entry}$ of the electrons on entering into the second gas cloud 14 and the energy $E_{exit}$ of the electrons on exiting from the second gas cloud 14, is advantageously less than 50%, better less than 40%, even better less than 30%, preferably even less than 20% and even more preferably less than 10%.

According to a variant, in order to collimate the electron beam on exiting from the second gas cloud, the triplet comprising length of the second gas cloud 14, distance d between the two gas clouds and electron density in the second gas cloud 14 is chosen to reduce a factor equal to the ratio of the divergence of the electron beam, divided by the energy of the electrons to the power ¾. In particular, this triplet may be chosen to reduce this factor by a ratio of two or, preferably, by a ratio greater than two, between the exit from the first gas cloud 24 and the exit from the second gas cloud 14.

According to another variant, in which a focusing of the electron beam is sought, the triplet comprising length of the second gas cloud 14, distance d between the two gas clouds and electron density in the second gas cloud 14 is chosen to reduce the dimensions of the electron beam in at least one plane transversal to the direction of propagation of the beam, preferably in all the planes transversal to the direction of propagation of the beam, on exiting from the second gas cloud 14 relative to its dimensions on exiting from the first gas cloud 24. Preferably, these dimensions in a transverse plane, preferably in all the transverse planes, are reduced by a factor of two, more preferably by a factor greater than two.

Generally, the gas of the first gas cloud is denser than the gas of the gas cloud of the collimating or focusing device, the density of the first gas cloud being for example greater than $5.10^{18}$ molecules per $cm^3$, preferably greater than $10^{19}$ molecules per $cm^3$, the density of the gas cloud of the collimating or focusing device being for example less than $5.10^{18}$ molecules per $cm^3$, preferably less than $10^{18}$ molecules per $cm^3$. It should be noted however that the density values may vary significantly according to the properties of the laser pulse and of the electrons. Furthermore, the device of FIG. 100 works also if the density of the second gas cloud is equal to or greater than that of the first gas cloud.

The device 100 makes it possible to implement the following method for emitting a bunch of collimated or focused relativistic electrons. First of all, a laser pulse is emitted that is focused in a first ionizable gas cloud, to create therein a wave of electrical and magnetic fields for accelerating electrons present in the gas and thus form a bunch of relativistic electrons which is propagated out of the first gas cloud. Since the laser pulse is also focused in a second ionizable gas cloud, it creates therein a wave of focusing electrical and magnetic fields. The first gas cloud is remote from the second ionizable gas cloud. Then, the bunch of relativistic electrons is subjected to the wave of focusing electrical and magnetic fields.

Figure 6:
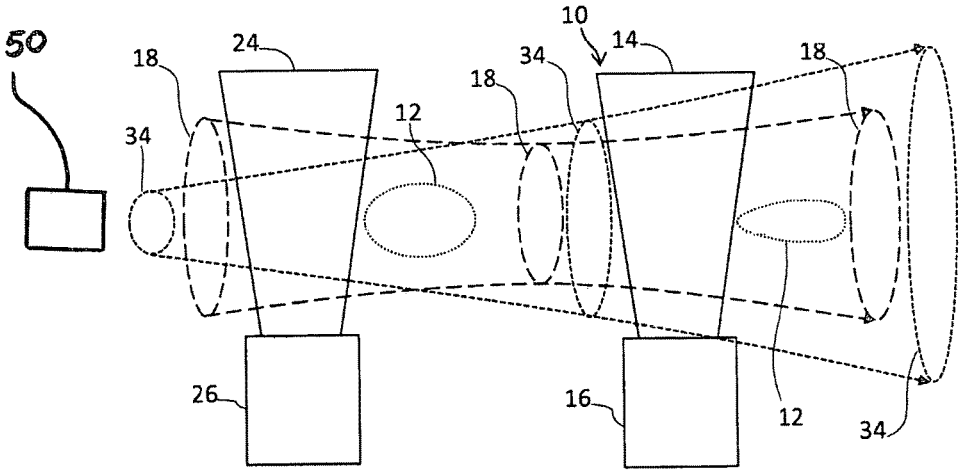
FIG. 6 schematically represents an example of a device for emitting a bunch of collimated or focused relativistic electrons, implementing two distinct laser pulses.

FIG. 6 represents a device for emitting a bunch of collimated or focused relativistic electrons 200 according to a second example. This device 200 is distinguished from the device 100 of FIG. 2 essentially in that it implements two laser pulses 18, 34, for example from one and the same laser and split upstream of the first gas cloud 24.

The laser is thus suitable for emitting a first laser pulse 34 focused in the first ionizable gas cloud 24, to create therein a first wave of electrical and magnetic fields for accelerating electrons present in the gas and thus form a bunch of relativistic electrons 12 which is propagated out of the first gas cloud 24. This laser is also suitable for emitting a second laser pulse 18 focused in the second ionizable gas cloud 14, to create therein a second wave of electrical and magnetic fields, for collimating or focusing the bunch of relativistic electrons 12.

Preferably, the second laser pulse precedes the first laser pulse by a few tenths of femtoseconds. This delay between the two laser pulses 34, 18 may be set for the bunch of electrons 12 to be located in a focusing zone of the wave of electrical and magnetic fields produced in the second gas cloud 14 by the second laser pulse 18.

The density of the gas of the second gas cloud is chosen preferably to be relatively low, for example less than $10^{18}$ molecules per $cm^3$ for the wake of the second laser pulse to encompass all of the bunch of electrons 12. The length of the second gas cloud 14 is for example 100 μm. Preferably, in the case of the device of FIG. 6, the electron density $n_e$ in the second gas cloud 14 and the length $L_e$ of the second gas cloud 14 are chosen such that the following inequation is borne out:

$$\frac{L_e}{L_0} \times \sqrt{\left(\frac{n_e}{n_0}\right)} < \frac{1}{2} \qquad [1]$$

in which $n_0=10^{18}$ electrons/$cm^3$ and $L_0$=1 mm.

The two laser pulses may be of different wavelengths. Preferably however, they have the same wavelength.

The first and second gas clouds are here also remote by a distance of the order of a millimeter, such that the bunch of relativistic electrons is propagated in the vacuum in the space between these two gas clouds. Obviously, this order of magnitude is nonlimiting, and the distance between the two gas clouds will be able to be determined as explained above in the case of the device 100.

This device for emitting a bunch of collimated or focused relativistic electrons 200 operates substantially like the emission device 100. In particular, the phase portrait of the bunch of electrons exhibits the same variations in this device 200 as in the device 100. However, the electrical and magnetic fields in the second gas cloud are stronger in this device 200 than in the case of the device 100. Thus, the second gas cloud in the device 200 may be shorter than in the case of the emission device 100.

Furthermore, this device 200 exhibits fewer aberrations than the device 100. In effect, in the case of the device 200, the second laser pulse corresponds to the bubble regime, in the second gas cloud. In this case, the focusing electrical and magnetic fields in this second gas cloud are proportional to the distance to the axis of propagation of the second laser pulse. This allows for a more effective collimation of the bunch of relativistic electrons, notably relative to the device 100, in which the laser pulse in the second gas cloud corresponds to the quasi-linear regime. Consequently, the focusing electrical and magnetic fields in the second gas cloud of this device 100 are proportional to the distance to the axis only close to the axis and approximately. The electrons with the greatest angles of propagation may then not see the same focusing fields as the electrons with the smaller angles of propagation. The collimation length may then depend on the initial angle of propagation of the electrons, which may limit the collimating effect.

The device 200 also makes it possible to better focus the high energy electrons, for example those whose energy is greater than 1 GeV. The fields in the device 100 are in fact generally too weak to effectively focus these electrons.

The device 200 makes it possible to implement the following method for emitting a bunch of collimated or focused relativistic electrons. A first laser pulse is emitted that is focused in a first ionizable gas cloud to create therein a wave of electrical and magnetic fields for accelerating electrons present in the gas and thus form a bunch of relativistic electrons which is propagated out of the first ionizable gas cloud. A second laser pulse is emitted that is focused in a second ionizable gas cloud to create therein a wave of focusing electrical and magnetic fields, the first ionizable gas cloud being remote from the second ionizable gas cloud. Finally, the bunch of relativistic electrons is subjected to the wave of focusing electrical and magnetic fields.

The invention is not limited to only the exemplary embodiments described above in light of the figures, as illustrative and nonlimiting examples.

In particular, the or each gas cloud may be obtained by implementing at least one out of a capillary, a discharge capillary, a capillary leak system, a sonic nozzle, a supersonic nozzle and a gas cell to produce each gas cloud.

The invention claimed is:

1. A device for emitting a bunch of collimated or focused relativistic electrons, comprising:

a first gas cloud;

a laser for emitting a first laser pulse focused in the first gas cloud to create therein a first wave of electrical and magnetic fields for accelerating electrons present in the first gas cloud and thus form a bunch of relativistic electrons which is propagated out of the first gas cloud; and a collimating or focusing device placed on the trajectory of propagation of the bunch of relativistic electrons, the device comprising a second gas cloud remote from the first gas cloud, the bunch of relativistic electrons being propagated in a vacuum in a space between the first gas cloud and the second gas cloud; and a second laser pulse emitted by said laser or a second laser being focused in the second gas cloud to create therein a wave of focusing electrical and magnetic fields, the width of the second gas cloud lying between 10 μm and 2 mm.

2. The device as claimed in claim 1, further comprising:

a single laser for emitting a laser pulse focused both in the first gas cloud to create therein a first wave of electrical and magnetic fields for accelerating electrons present in the first gas cloud, and in the second gas cloud to create therein a wave of focusing electrical and magnetic fields.

3. The device as claimed in claim 1, further comprising:

two distinct lasers for emitting two distinct laser pulses, of which one is focused in the first gas cloud to create therein a first wave of electrical and magnetic fields for accelerating electrons present in the first gas cloud, and of which the other is focused in the second gas cloud to create therein a wave of focusing electrical and magnetic fields.

4. The device as claimed in claim 1, wherein the distance (d) between the first gas cloud and the second gas cloud is greater than 300 μm and/or less than 5 mm.

5. The device as claimed in claim 1, further comprising:

at least one out of a capillary, a discharge capillary, a capillary leak system, a sonic nozzle, a supersonic nozzle and a gas cell to produce each gas cloud.

6. The device as claimed in claim 1, wherein the second laser pulse has a duration lying between 5 and 500 femtoseconds and/or a peak power lying between 10 terawatt and 10 petawatt.

7. The device as claimed in claim 3, wherein the length $L_e$ and the electron density $n_e$ of the second gas cloud are such that:

$$\frac{L_e}{L_0} \times \sqrt{\left(\frac{n_e}{n_0}\right)} < \frac{1}{2}$$

wherein $n_0=10^{18}$ electrons/cm$^3$ and $L_0=1$ mm.

8. The device as claimed in claim 1, wherein the length and the electron density of the second gas cloud and the distance between the first gas cloud and the second gas cloud, where appropriate, are chosen such that the energy variation of the electron beam between entry into and exit from the second gas cloud is less than 50%.

9. The device as claimed in claim 1, wherein the length and the electron density of the second gas cloud and the distance between the first gas cloud and the second gas cloud, where appropriate, are chosen such that the factor equal to the divergence of the electron beam, divided by the energy of the electrons of the beam to the power ¾, is reduced between entry into the second gas cloud or exit from the first gas cloud, where appropriate, and exit from the second gas cloud, by a ratio of two or more.

10. The device as claimed in claim 1, wherein the length and the electron density of the second gas cloud and the distance between the first gas cloud and the second gas cloud, where appropriate, are chosen such that the dimensions of the electron beam in a plane transversal to the direction of propagation of the electron beam are reduced between entry into the second gas cloud or exit from the first gas cloud, where appropriate, and exit from the second gas cloud, by a ratio of two or more.

11. A method for emitting a bunch of collimated or focused relativistic electrons, comprising:

emitting a laser pulse focused in a first gas cloud to create therein a wave of electrical and magnetic fields for accelerating electrons present in the first gas cloud and thus form a bunch of relativistic electrons which is propagated out of the first gas cloud, the laser pulse also being focused in a second gas cloud remote from the first gas cloud to create therein a wave of focusing electrical and magnetic fields, the first gas cloud being remote from the second gas cloud; and subjecting the bunch of relativistic electrons to the wave of focusing electrical and magnetic fields, wherein the width of the second gas lies between 10 μm and 2 mm, and the bunch of relativistic electrons is propagated in a vacuum in a space between the first and second gas clouds.

12. A method for emitting a bunch of collimated or focused relativistic electrons, comprising:

emitting a first laser pulse focused in a first gas cloud to create therein a wave of electrical and magnetic fields for accelerating electrons present in the first gas cloud and thus form a bunch of relativistic electrons which is propagated out of the first gas cloud;

emitting a second laser pulse focused in a second gas cloud remote from the first gas cloud to create therein a wave of focusing electrical and magnetic fields, the first gas cloud being remote from the second gas cloud; and subjecting the bunch of relativistic electrons to the wave of focusing electrical and magnetic fields, wherein the width of the second gas cloud lies between 10 μm and 2 mm, and the bunch of relativistic electrons is propagated in a vacuum in a space between the first gas cloud and the second gas cloud.

13. The method as claimed in claim 11, wherein the distance between the first gas cloud and the second gas cloud is greater than 300 μm and/or less than 5 mm.

14. The method as claimed in claim 11, wherein the laser pulse, where appropriate, has a duration lying between 5 and 500 femtoseconds, and/or a peak power lying between 10 terawatt and 10 petawatt.

15. The method as claimed in claim 12, wherein the length $L_e$ and the electron density $n_e$ of the second gas cloud are such that:

$$\frac{L_e}{L_0} \times \sqrt{\left(\frac{n_e}{n_0}\right)} < \frac{1}{2}$$

wherein $n_0=10^{18}$ electrons/cm$^3$ and $L_0=1$ mm.

16. The method as claimed in claim 11, wherein the length and the electron density of the second gas cloud and the distance between the first gas cloud and the second gas cloud, where appropriate, are chosen such that the energy variation of the electron beam between entry into and exit from the second gas cloud is less than 50%.

17. The method as claimed in claim 11, wherein the length and the electron density of the second gas cloud and the distance between the first gas cloud and the second gas cloud, where appropriate, are chosen such that the factor equal to the divergence of the electron beam, divided by the energy of the electrons to the power ¾, is reduced between entry into the second gas cloud or exit from the first gas cloud, where appropriate, and exit from the second gas cloud, by a ratio of two or more.

18. The method as claimed in claim 11, wherein the length and the electron density of the second gas cloud and the distance between the first gas cloud and the second gas cloud, where appropriate, are chosen such that the dimensions of the electron beam in a plane transversal to the direction of propagation of the electron beam are reduced between entry into the second gas cloud or exit from the first gas cloud, where appropriate, and exit from the second gas cloud, by a ratio of two or more.

19. A device for emitting a bunch of collimated or focused relativistic electrons, comprising:

a first gas cloud;

a laser for emitting a first laser pulse focused in the first gas cloud to create therein a first wave of electrical and magnetic fields for accelerating electrons present in the first gas cloud and thus form a bunch of relativistic electrons which is propagated out of the first gas cloud; and a collimating or focusing device placed on the trajectory of propagation of the bunch of relativistic electrons, the device comprising a second gas cloud remote from said first gas cloud and where a second laser pulse emitted by the same laser or other second laser is focused to create therein a wave of focusing electrical and magnetic fields, wherein the length and the electron density of the second gas cloud and the distance between the first and second gas cloud, where appropriate, are chosen such that the factor equal to the divergence of the electron beam, divided by the energy of the electrons of the beam to the power ¾, is reduced between entry into the second gas cloud or exit from the first gas cloud, where appropriate, and exit from the second gas cloud, by a ratio of two or more.

20. A device for emitting a bunch of collimated or focused relativistic electrons, comprising:

a first gas cloud;

a laser for emitting a first laser pulse focused in the first gas cloud to create therein a first wave of electrical and magnetic fields for accelerating electrons present in the first gas cloud and thus form a bunch of relativistic electrons which is propagated out of the first gas cloud; and a collimating or focusing device placed on the trajectory of propagation of the bunch of relativistic electrons, the device comprising a second gas cloud remote from said first gas cloud and where a second laser pulse emitted by the same laser or other second laser is focused to create therein a wave of focusing electrical and magnetic fields, wherein the length and the electron density of the second gas cloud and the distance between the first and second gas cloud, where appropriate, are chosen such that the dimensions of the electron beam in a plane transversal to the direction of propagation of the electron beam are reduced between entry into the second gas cloud or exit from the first gas cloud, where appropriate, and exit from the second gas cloud, by a ratio of two or more.

21. A method for emitting a bunch of collimated or focused relativistic electrons, comprising:

emitting a laser pulse focused in a first gas cloud to create therein a wave of electrical and magnetic fields for accelerating electrons present in the first gas and thus form a bunch of relativistic electrons which is propagated out of the first gas cloud, the laser pulse also being focused in a second gas cloud to create therein a wave of focusing electrical and magnetic fields, the first gas cloud being remote from the second gas cloud; and subjecting the bunch of relativistic electrons to the wave of focusing electrical and magnetic fields, wherein the length and the electron density of the second gas cloud and the distance between the first gas cloud and the second gas cloud, where appropriate, are chosen such that the factor equal to the divergence of the electron beam, divided by the energy of the electrons to the power ¾, is reduced between entry into the second gas cloud or exit from the first gas cloud, where appropriate, and exit from the second gas cloud, by a ratio of two or more.

22. A method for emitting a bunch of collimated or focused relativistic electrons, comprising:

emitting a laser pulse focused in a first gas cloud to create therein a wave of electrical and magnetic fields for accelerating electrons present in the first gas and thus form a bunch of relativistic electrons which is propagated out of the first gas cloud, the laser pulse also being focused in a second gas cloud to create therein a wave of focusing electrical and magnetic fields, the first gas cloud being remote from the second gas cloud; and subjecting the bunch of relativistic electrons to the wave of focusing electrical and magnetic fields, wherein the length and the electron density of the second gas cloud and the distance between the first gas cloud and the second gas cloud, where appropriate, are chosen such that the dimensions of the electron beam in a plane transversal to the direction of propagation of the electron beam are reduced between entry into the second gas cloud or exit from the first gas cloud, where appropriate, and exit from the second gas cloud, by a ratio of two or more.

* * * * *